United States Patent [19]

Siemonsen

[11] 4,089,199

[45] May 16, 1978

[54] BALL BAT AND METHOD OF MAKING THE SAME

[75] Inventor: Frederik A. Siemonsen, Richmond, Va.

[73] Assignee: Reynolds Metals Company, Richmond, Va.

[21] Appl. No.: 777,432

[22] Filed: Mar. 14, 1977

[51] Int. Cl.[2] ..... B21D 51/16

[52] U.S. Cl. ..... 72/370

[58] Field of Search ..... 273/72 A; 72/283, 370

[56] References Cited

U.S. PATENT DOCUMENTS

| | | | |
|---|---|---|---|
| 3,243,986 | 4/1966 | Douthett et al. | 72/370 |
| 3,807,213 | 4/1974 | Willis et al. | 72/370 |

*Primary Examiner*—Lowell A. Larson

*Attorney, Agent, or Firm*—Glenn, Lyne, Gibbs and Clark

[57] ABSTRACT

A hollow metal ball bat having a barrel of a relatively large diameter, a tapered intermediate portion and a handle portion of a relatively small diameter and method of making the same. The bat is formed from a metal tube, a section of which is initially enlarged in diameter and thereafter is drawn through an ironing die and then swaged down to an outside diameter smaller than the original tube diameter, to form the handle of the bat. An intermediate section of the tube is similarly reformed but to a tapered shape to provide an intermediate portion of the bat. The barrel of the bat may be left unchanged in the form of the original tube. The process can provide a completed bat having a substantially uniform wall thickness closely approximating the original wall thickness of the metal tube from which the bat is formed.

7 Claims, 8 Drawing Figures

BALL BAT AND METHOD OF MAKING THE SAME

BACKGROUND OF THE INVENTION

Bats for hitting balls vary with the particular game being played, but they have the common characteristic of comprising a handle portion at one end for grasping the bat, and a barrel portion at the other end for hitting the ball and an intermediate portion connecting the two end portions. In the case of the American baseball, for example, there are differences between bats used for professional baseball, bats used for the soft ball, and bats used for Little League games, but in general a design good for one of these uses can be adapted to the other uses.

Wooden ball bats have been conventional for years in all three types of American baseball mentioned above. However, the combination of population increase and lumber resources decrease has led to a search for other materials for making such bats. While all sorts of metals might be used, aluminum and aluminum base alloys are especially well suited for this purpose, considering strength to weight ratio, surface chracteristics, formability and cost. While aluminum bats presently cost more than wood bats, they have the great advantage of lasting longer, and hence of costing less in the long run.

Early efforts to develop aluminum bats included the approach of mounting a cylindrical tube of extruded aluminum in a lathe and spinning it down by pressure of a blunt instrument against the outside of the workpiece as it was rotated with a shaping mandrel inside. The resultant shaped metal bat stock had its original extruded form along one end, where it was designed to hit balls, an intermediate tapered portion and a reduced diameter at its handle end, where it was designed to be gripped. A bat made in this way had generally uniform thickness of its metal wall from end to the other. The metal at the tapered portion and the handle end was forced longitudinally away from the center of the bat, thus lengthening the original cylindrical extrusion. There was less metal per unit length at the tapered and handle end of the bat, because of the uniformity of wall thicknes in conjunction with decreased diameter at the tapered and handle end. As a result, the center of gravity of the bat was displaced from the geometric center of the length of the bat in the direction of the hitting end of the bat. A bat made in this way thus had its weight per unit length concentrated toward the hitting end, where it should be for best results, and where it exists inherently in conventional solid wooden bats. Unfortunately, the spinning step was relatively expensive, and this system of bat manufacture apparently has never been employed on a large commercial scale.

An improvement over the turned bats is disclosed in Swenck's U. S. Pat. No. 3,691,625 issued Sept. 19, 1972. In accordance with the teaching of that patent, a length of cylindrical aluminum extrusion is swaged down in a rotating die having a tapered throat into which one end of the extrusion is pressed. As the the die rotates, the metal is compressed. As compression occurs, the metal extrusion is thrust further into the die, until the workpiece has completed a predetermined distance of movement into the die. As explained in the patent, the swaged down portion of the workpiece is then internally drilled coaxially until at least most of the thickened end of the workpiece has been drilled out to leave a metal wall for the handle portion having a thickness not substantially greater than the wall thickness of the ball hitting portion of the bat.

SUMMARY OF IMPROVEMENT

In accordance with the present invention, the good hitting characteristics of the earlier lathe spun metal bats are combined with the low cost production characteristics of the swaged bats. This is accomplished by first expanding the handle and the intermediate sections of the tubular workpiece to enlarge the inside and outside diameter of each of these sections without regard to controlling the wall thickness of either section. The workpiece is then ironed on a mandrel to form a blank having a constant outside diameter but having sections of varying inside diameters. The workpiece is then removed from the mandrel and swaged, for example, as taught in the Swenck patent to form a bat having a wall thickness which is substantially constant the entire length thereof. The result is a metal bat which has good weight distribution per unit length.

BRIEF DESCRIPTION OF THE DRAWINGS

The accompanying drawings show, for purposes of illustration only, a present preferred embodiment of the invention. In the drawings.

DESCRIPTION OF ILLUSTRATED EMBODIMENT

Figure 1:
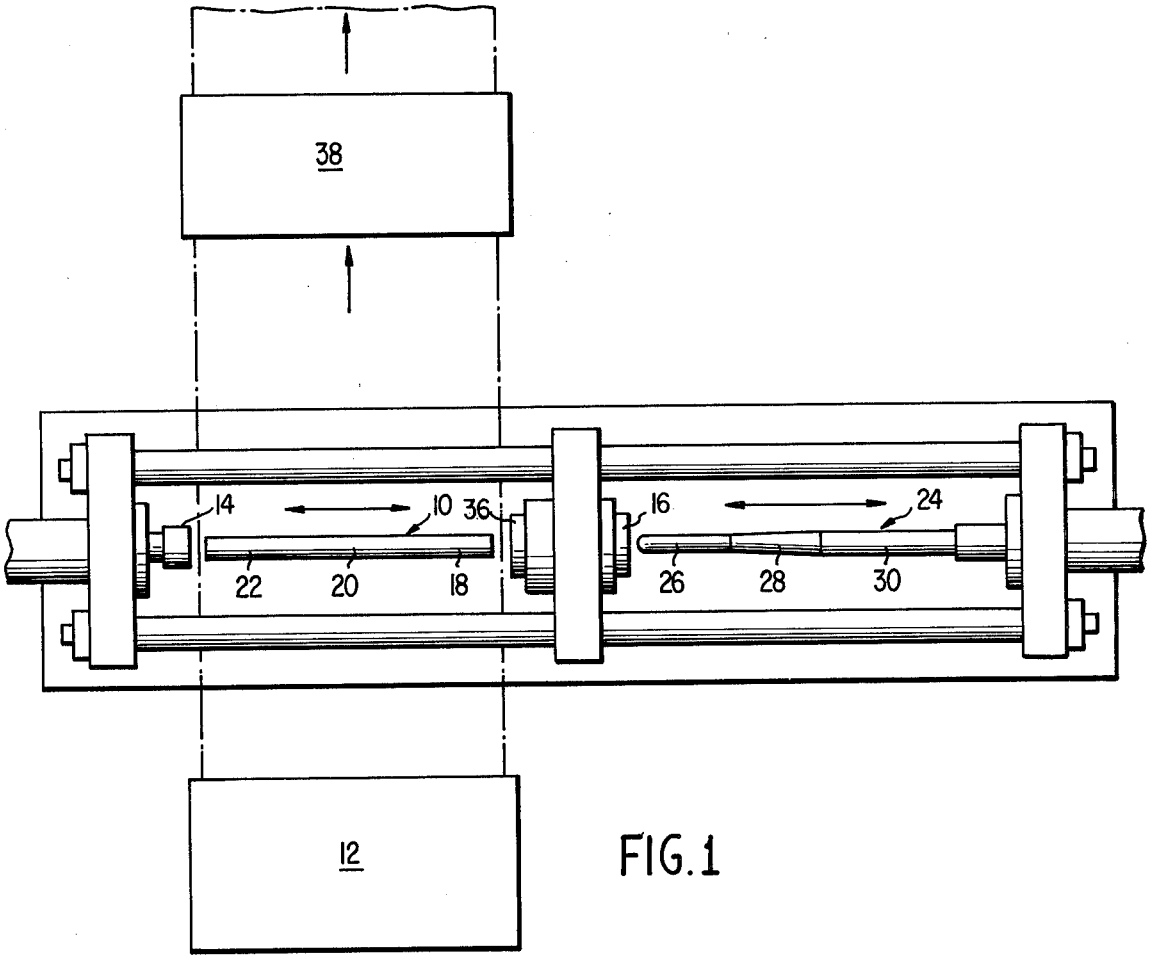
FIG. 1 shows an apparatus for expanding and ironing a tubular metal workpiece.
Figure 5:
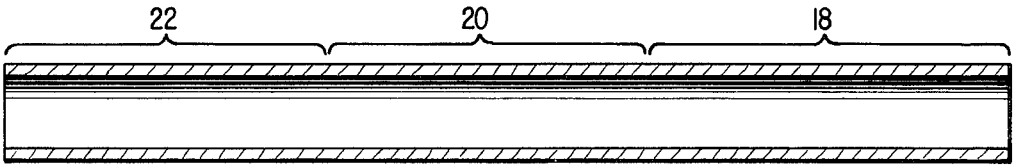
FIG. 5 shows in section a single piece, seamless tubular, hollow metal working thereof.

Referring now more particularly to the drawings, the illustrated single piece, seamless tubular hollow metal workpiece 10 is removed from the tube hopper 12 to the position shown in FIG. 1 between the clamping collet 14 and the support structure supporting the stripper 36 and the ironing die 16. The metal tube 10 is then inserted into and rigidly gripped by the collet 14, ready to be thrust through the stripper 36 and the ironing die 16 without any ironing of the workpiece occurring. The collet 14 is first moved to the right with the ironing die always fixed in place. The metal tube consists of generally three sections as best seen in FIG. 5. Section 18 is designated as the handle section. Section 20 is designated as the intermediate section and section 22 is designated as the barrel section. These three sections or portions are so designated because in the final product, a ball bat, they become the handle, intermediate and barrel portions, respectively.

As the tubular workpiece 10 is passed through the ironing die 16 the handle section 18 of the tube passes over the first segment 26 of the extended mandrel 24 without any enlarging of the handle section's diameter. It is to be understood that the interior of the workpiece and the mandrel are well lubricated to eliminate as much friction as possible during the forming of the bat blank. As the extreme right hand end of the tube 10 comes into contact with the tapered or second segment of mandrel 28 of the handle section 18 of the tube is progressively expanded as it travels over the second segment of the mandrel 28. Simultaneously, the intermediate section 20 of the tube 10 is beginning to pass over the first segment 26 of the mandrel without any enlargement thereof. At such time as approximately two thirds of the metal tube has been forced over the mandrel, the handle section has been partially reformed. The handle section 18 is expanded over the second segment of the mandrel while the intermediate section 20 is merely passing over the first section 26 of the mandrel.

In order to continue to reform the metal tube into a metal blank for subsequently making a ball bat the tube 10 is subsequently moved further to the right such that the handle section 18 is passed over a third segment 30 of the mandrel while simultaneously the intermediate section 20 is expanded over the second segment 28 of the mandrel and the barrel section 22 is merely passed over the first segment 26 of the mandrel without any expansion thereof.

Figure 6:
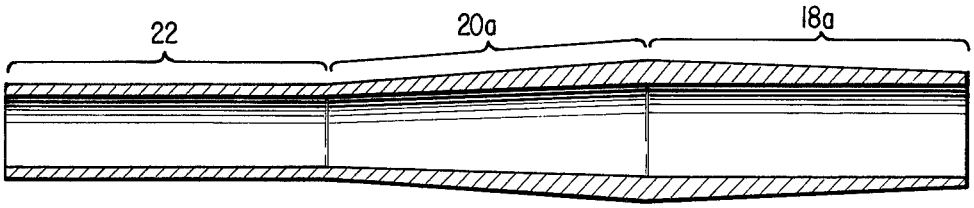
FIG. 6 shows in section the workpiece after it has been expanded on the mandrel.

Upon the completion of the above sequence of steps the handle and intermediate sections of the metal tube 10 will be reformed on the mandrel in the form shown in FIG. 6 (not to scale). That is, the barrel section 22 will be of an approximate constant outer and inner diameters equal to the outer and inner diameters of the original workpiece 10. The intermediate section **20*a* will have a tapering inner diameter which conforms to the outer diameter of the second segment 28 of the mandrel. The handle section will have a constant internal diameter equal to the outer diameter of the third segment 30** of the mandrel.

It should be noticed that while the internal diameters of the metal workpiece have been carefully controlled in performing the above sequence of steps on the mandrel, there has been no direct control of the outside diameters of the workpiece. As shown in FIG. 6, the barrel section 22 remains substantially constant in wall thickness, but the wall thicknesses of the intermediate section **20*a* and handle section 18*a* are altered considerably but not necessarily quite to the scale as shown in FIG. 6**.

Figure 2:
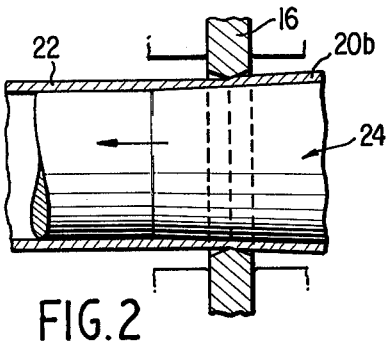
FIG. 2 shows in section a cylindrical metal workpiece entering an ironing die.

After the workpiece 10 has been pressed over the mandrel 24 to produce an intermediate workpiece as shown in FIG. 6, the next step in making the metal bat blank consists of ironing the blank by simultaneously moving the mandrel 24 and the collet 14 to the left thereby passing the workpiece 10 through the ironing die 16. As the barrel section 22 of the workpiece passes through the ironing die there is little or no ironing of the blank. However, as the intermediate section **20*b* of the blank enters the ironing die (see FIG. 2) there is progressively a greater amount of ironing of the enlarged section 20*a* until the handle section 18*c* enters the ironing die. Ironing of the handle section 18*a*** occurs during the entire time the handle section is passing through the die.

Figure 7:
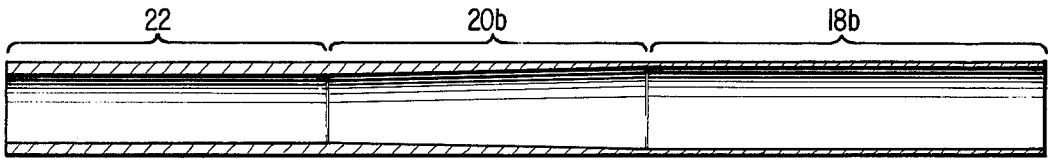
FIG. 7 shows in section the workpiece after it has been ironed and stripped from the mandrel.

Upon the completion of the ironing step the metal blank will have been reformed in the form as shown in FIG. 7. The outside diameter of the blank is substantially constant from end to end. The inside diameter of the barrel section 22 and the inside diameter of the handle section **18*b* are substantially constant but unequal (the inside diameter of the barrel section 22 being smaller than the inside diameter of the handle section). These two sections are connected by the intermediate section 20*b*** having a tapering inside diameter and constant outside diameter.

Figure 3:
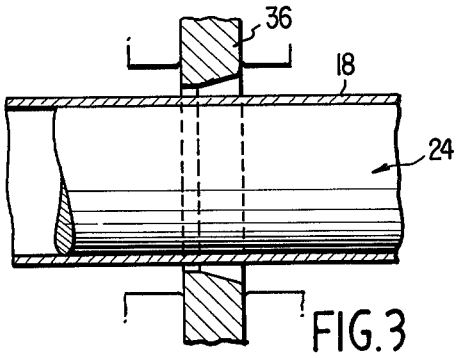
FIG. 3 shows in section the stripper in the open position.
Figure 4:
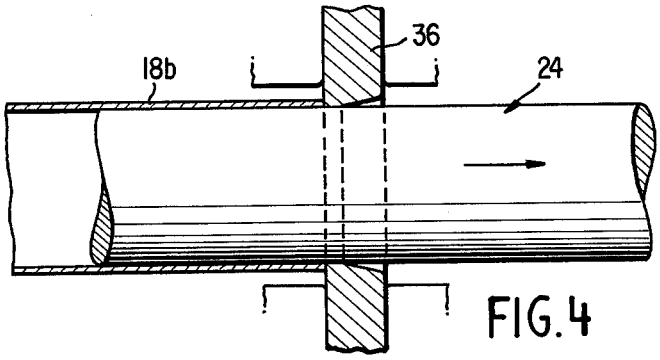
FIG. 4 shows in section the stripper in the closed position stripping the expanded and ironed workpiece from the mandrel.

The metal blank shown in FIG. 7 is then withdrawn from the mandrel 24 by closing the stripper jaws 36, shown in the open position in FIG. 3. At such time as the mandrel has been moved as far to the left position as possible, completing the ironing step, and moved far enough for the stripping jaws 36 to be closed about the mandrel 24 clear of the workpiece 10 the mandrel is returned to the extreme right hand position as shown in FIG. 1. Thereupon, the workpiece is stripped from the mandrel leaving the reformed workpiece of FIG. 7 in the initial position of the beginning workpiece 10 shown in FIG. 1. After the workpiece has been stripped from the mandrel the intermediate workpiece of FIG. 7 is now ready to be further worked to form a bat having the physical and metallurgical characteristics herein described.

EXAMPLE

A bat made in accordance with this invention could be made from a single piece, seamless cylindrical, tubular, hollow metal member having an outside diameter of 2.125 inches and a wall thickness of 0.105 inches. Preferably, the metal is of an aluminum alloy which is heat treatable. Suitable alloys are: X 7046, 7005, 7116 and 7129 all in the O temper.

Figure 8:
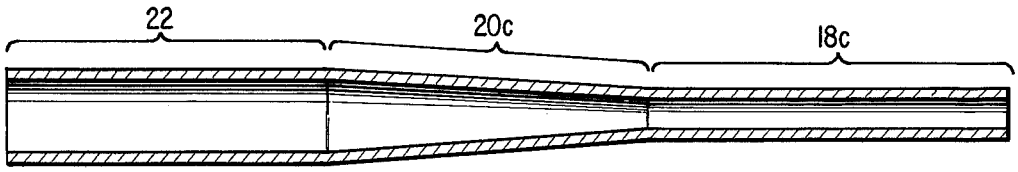
FIG. 8 shows in section the workpiece after it has been swaged down for further forming to make a completed ball bat.

As described above, after the workpiece shown in FIG. 7 has been stripped from the mandrel it is further worked to form the partially finished bat of FIG. 8. Such further working of the workpiece could be by swaging of the FIG. 7 workpiece in the manner and with an apparatus 38 as taught by the before-mentioned Swenck U.S. Pat. No. 3,691,625. Upon the swaging of the handle portion **18*b* and a partial swaging of the intermediate portion 20*b* a bat having a substantially uniform wall thickness from end to end as shown in FIG. 8** will be formed.

Further, turning of the extreme end of the barrel portion 22 may be performed to enable a relatively secure placement of an end closure plug therein or the complete closure thereof. Also the extreme end of the handle portion **18*c* may be fitted with an appropriate grip as shown in Scott's U.S. Pat. No. 4,000,895 to complete the manufacture of a finished bat. As noted above the original bat stock is preferably a heat treatable aluminum alloy of a relatively soft temper. Upon the completion of the basic reforming steps to produce the bat shown in FIG. 8** the bat may be heat treated to achieve the desired physical and metallurgical characteristics of a bat for its intended use as in Little League or softball, for example.

While present preferred embodiments of the invention have been illustrated and described, it will be recognized that the invention may be otherwise variously embodied and practiced within the scope of the following claims.

I claim:

1. In the method of making a hollow metal ball bat having a substantially uniform wall thickness along the length thereof from a hollow metal tube having a substantially uniform inside and outside diameter the metal bat comprising an elongated hollow body having a cylindrical barrel portion of one outer diameter, a cylindrical handle portion of a reduced outer diameter and an intermediate portion of a tapering outer diameter between said barrel and handle portions, the method of making a ball bat blank including expanding the tube along part of its length over a mandrel having a tapered segment and a cylindrical segment having an outside diameter larger than the inside diameter of the tube, the steps of:

(a) expanding the handle portion of the tube over the tapered segment of the mandrel, (b) subsequently expanding the handle portion of the tube over the cylindrical segment of the mandrel while simultaneously expanding the intermediate portion of the tube over the tapered segment of the mandrel, and (c) ironing the outside of the said tube where it has been expanded in steps (a) and (b) to substantially the original outside diameter of the tube to form a metal blank having the outside thereof substantially uniform in diameter and the inside diameter of the barrel portion and the inside diameter of the handle portion being substantially uniform in diameter and said barrel and said handle portions being connected by an intermediate portion and said handle portion having a larger inside diameter than said barrel portion inside diameter.

2. The method of claim 1 including the steps of removing the ironed metal blank from the mandrel, and reducing the outer diameter of the handle portion of the blank to form the handle portion of said bat and progressively reducing the outer diameter of the intermediate portion whereby the wall thicknesses of the handle and intermediate portions of the bat upon the completion of the reducing steps are substantially the same as the wall thickness of the barrel portion of the bat.

3. The method of claim 1 wherein the metal tube has an inwardly curved extremity which engages the forward end of a first segment of the mandrel.

4. The method of claim 1 wherein the metal tube is an impact extruded tube workpiece providing a closed end wall which engages the forward end of a first segment of the mandrel.

5. The method of claim 1 wherein the blank is ironed on a mandrel having two, spaced constant diameter segments of different diameters, and an intermediate, tapered segment extending between said constant diameter segments.

6. The method of claim 1 wherein the metal is a heat treatable aluminum alloy.

7. The method of making a hollow ball bat having a substantially uniform wall thickness along the length thereof from a hollow metal tube having a substantially uniform inside and outside diameter, the metal bat comprising an elongated hollow body having a cylindrical barrel portion of one outer diameter, a cylindrical handle portion of a reduced outer diameter and an intermediate portion of tapering outer diameter between said barrel and handle portions, the method of making the bat including the steps of:

(a) expanding the handle portion of the tube, (b) further expanding the handle portion of the tube while simultaneously expanding the intermediate portion of the tube, (c) ironing the outside of the said tube where it has been expanded in steps (a) and (b) to substantially the original outside diameter of the tube to form a metal blank having the outside thereof substantially uniform in diameter and the inside diameter of the barrel portion and the inside diameter of the handle portion being substantially uniform in diameter and said barrel and said handle portions being connected by an intermediate portion and said handle portion having a larger inside diameter than said barrel portion inside diameter, and (d) reducing the outer diameter of the handle portion of the tube to form the handle portion of said bat and progressively reducing the outer diameter of the intermediate portion whereby the wall thicknesses of the handle and intermediate portions of the bat upon the completion of the reducing step have substantially the same wall thickness as the wall thickness of the barrel portion of the bat.

* * * * *